US007191563B2

(12) United States Patent
Yokomori

(10) Patent No.: US 7,191,563 B2
(45) Date of Patent: Mar. 20, 2007

(54) TENSION ROLLER OF POWER SLIDE DEVICE FOR VEHICLE SLIDING DOOR

(75) Inventor: Kazuhito Yokomori, Yamanashi-ken (JP)

(73) Assignee: Mitsui Mining and Smelting Co., Ltd., Tokyo (JP)

( * ) Notice: Subject to any disclaimer, the term of this patent is extended or adjusted under 35 U.S.C. 154(b) by 64 days.

(21) Appl. No.: 11/006,814

(22) Filed: Dec. 8, 2004

(65) Prior Publication Data

US 2006/0032142 A1 Feb. 16, 2006

(30) Foreign Application Priority Data

Dec. 8, 2003 (JP) ..... 2003-408465

(51) Int. Cl.
*E05F 11/00* (2006.01)

(52) U.S. Cl. ..... 49/360; 296/155

(58) Field of Classification Search ..... 49/360, 49/215, 216; 296/155
See application file for complete search history.

(56) References Cited

U.S. PATENT DOCUMENTS 4,932,715 A * 6/1990 Kramer ..... 296/155
6,198,242 B1 * 3/2001 Yokomori et al. ..... 318/445

* cited by examiner

*Primary Examiner*—Jerry Redman
(74) *Attorney, Agent, or Firm*—Browdy and Neimark, PLLC

(57) ABSTRACT

A power slide device includes a first cable connected to a wire drum and moving in a first direction when wound up by the wire drum, a second cable connected to the wire drum and moving in a second direction when wound up by the wire drum, a first tension roller having a first abutting surface abutting against the first cable, and a second tension roller having a second abutting surface abutting against the second cable. The first abutting surface is taken as an inclined surface becoming gradually shorter in diameter toward the first direction, and the second abutting surface is taken as an inclined surface becoming gradually shorter in diameter toward the second direction.

2 Claims, 3 Drawing Sheets

FIG. 6
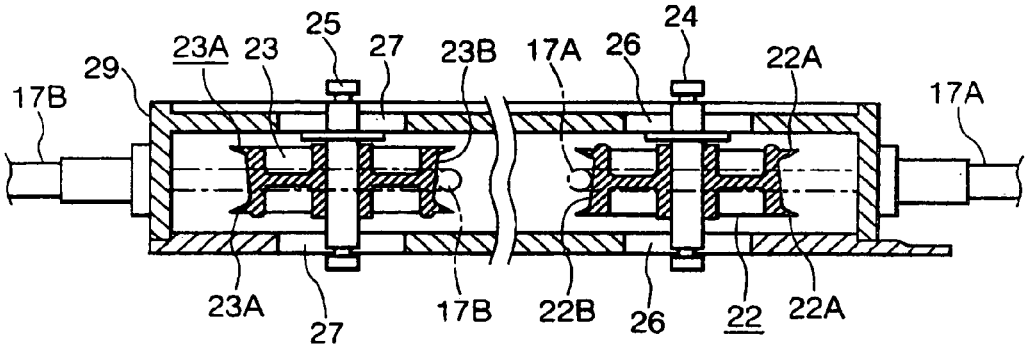
FIG. 7
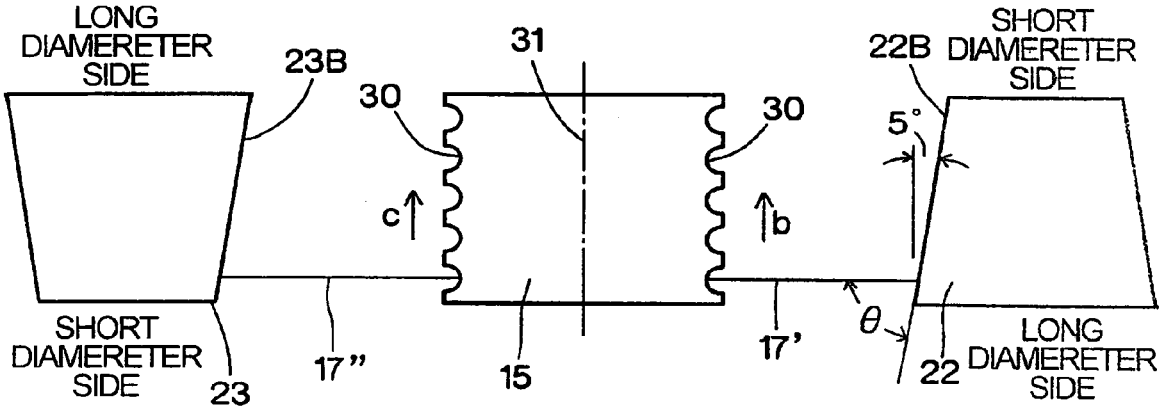
FIG. 8
| ABUTTING SURFACE ANGLE | DRUM ROTATIONAL DIRECTION | CABLE NOISE |
|---|---|---|
| ZERO DEGREE | WINDING DRECTION | NO GOOD |
| | PULLING DIRECTION | GOOD |
| THREE DEGREES | WINDING DRECTION | SLIGHTLY GOOD |
| | PULLING DIRECTION | GOOD |
| FIVE DEGREES | WINDING DRECTION | GOOD |
| | PULLING DIRECTION | GOOD |

TENSION ROLLER OF POWER SLIDE DEVICE FOR VEHICLE SLIDING DOOR

BACKGROUND OF THE INVENTION

1. Field of the Invention

The present invention relates to a tension mechanism in a power slide device for vehicle sliding door, and in particular, it relates to an improved tension roller for tension mechanism.

2. Description of the Related Art

In general, a conventional power slide device for vehicle sliding door comprises a wire drum rotated by motor, and a door-opening cable connected to the wire drum, and a door-closing cable connected to the wire drum. When the wire drum is rotated in a door-opening direction, the door-opening cable is wound up, and at the same time, the door-closing cable is pulled out, so that the sliding door is slid in the door-opening direction. On the contrary, when the wire drum is rotated in a door-closing direction, the door-opening cable is pulled out, and at the same time, the door-closing cable is wound up, so that the sliding door is slid in the door-closing direction.

The wire cable is retained at an appropriate tension by a tension mechanism. The tension mechanism comprises a pair of tension rollers biased in such a manner as to be adjacent to each other by elasticity of the springs.

FIG. 1 is a schematic view showing a relation among a wire drum A, a wire cable B, and a tension roller C. A typical thickness of the wire drum A along a drum shaft D is approximately 20 mm, and when the wire drum A rotates, the wire cable B is wound up (or pulled out), moving upward or downward guided by a helical engaging groove E of the wire drum A.

Since the typical tension roller C is a bobbin type roller with a short diameter in center, even if the wire cable B moves upward or downward in response to rotation of the wire drum A, the tension roller C substantially keeps the wire cable B at the center. The problem of this structure has been that the wire cable B is unmovable upward and downward relatively to the tension roller C. Hence, when the wire cable B moves upward or downward for the wire drum A, the wire cable B between the wire drum A and the tension roller C deviates widely from a right angle with the drum shaft D of the wire drum A, thereby often causing an engaging trouble between the wire cable B and the engaging groove E. The engaging trouble becomes serious as the distance between the wire drum A and the tension roller C becomes shorter. Consequently, the bobbin type tension roller C has been disposed at a place away from the wire drum A, thereby inviting a large size of the power slide device.

In contrast to this, as shown in FIG. 2, a tension roller C' which is formed into a cylindrical roller having the same diameter from the top to the bottom is also publicly known. A cylindrical tension roller C' attempts at miniaturization of the power slide device by forming the tension roller C' at approximately 20 mm in accordance with the thickness of the wire drum A so that the space between the tension roller C' and the wire drum A is made short.

The device of FIG. 2 has a problem in that a "cable rubbing noise" is generated when the wire drum A is rotated. A cause of the noise generation will be described below.

By the rotation of the wire drum A, when the cable B, for example, moves upward for the wire drum A, the upward movement of the cable B relatively to the tension roller C' is slightly delayed. Hence, an angle X between the cable B and the lower side surface of the roller C' exceeds more than 90 degrees. Then, a downward external force as shown by an arrow a is applied to the cable B in the vicinity of the roller C' so that the upward movement of the cable B in the vicinity of the roller C' is further delayed. As a result, the wire cable B rubs against an angular portion of the engaging groove E of the wire drum A, thereby generating the noise.

Further, the cable B in the vicinity of the roller C' abruptly moves in order to catch up on the delay of the upward movement, thereby causing the noise.

SUMMARY OF THE INVENTION

Therefore, an object of the present invention is to provide a tension roller of the power slide device having controlled the generation of noises by allowing the upward or downward movement of the cable for the tension roller to be smoothly performed.

BRIEF DESCRIPTION OF THE DRAWINGS

FIG. 6 is a partially abbreviated sectional view of the tension mechanism;

FIG. 7 is an explanatory view of the operation of the tension mechanism; and FIG. 8 is a table showing the experiment result of the tension mechanism according to the present invention.

DESCRIPTION OF THE PREFERRED EMBODIMENT

Figure 1:
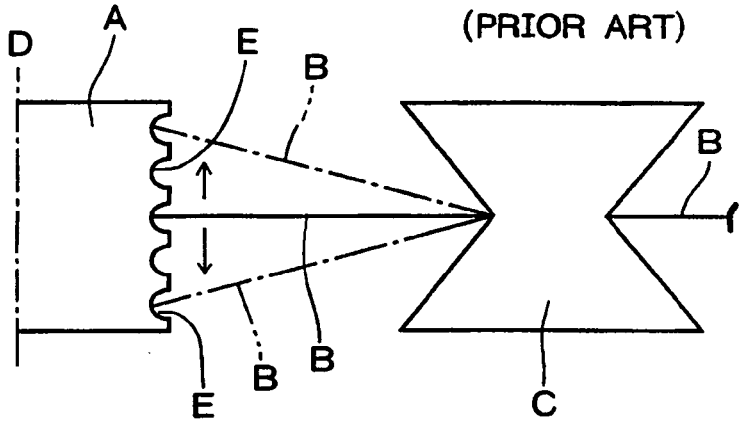
FIG. 1 (PRIOR ART)
FIG. 1 is a schematic view showing a relation among a wire drum, tension roller, and wire cable of a conventional device.
Figure 2:
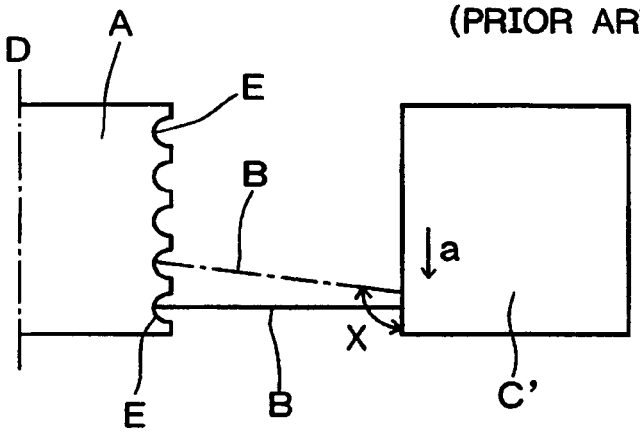
FIG. 2 (PRIOR ART)
FIG. 2 is a schematic view showing a relation among another conventional wire drum, tension roller, and wire cable.
Figure 3:
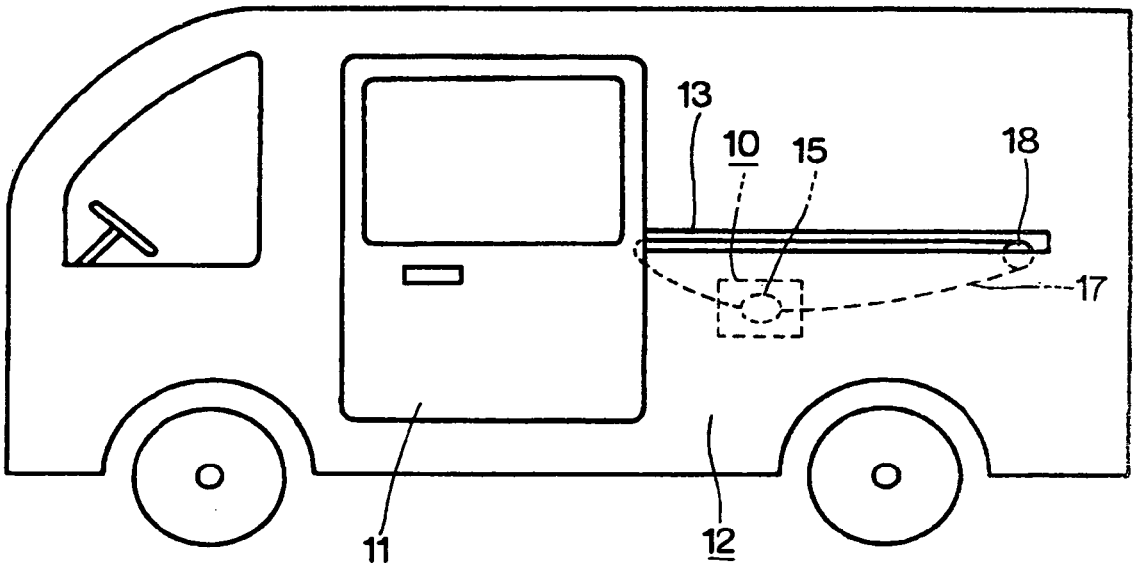
FIG. 3 is a side view of a vehicle including a power slide device of the present invention.
Figure 4:
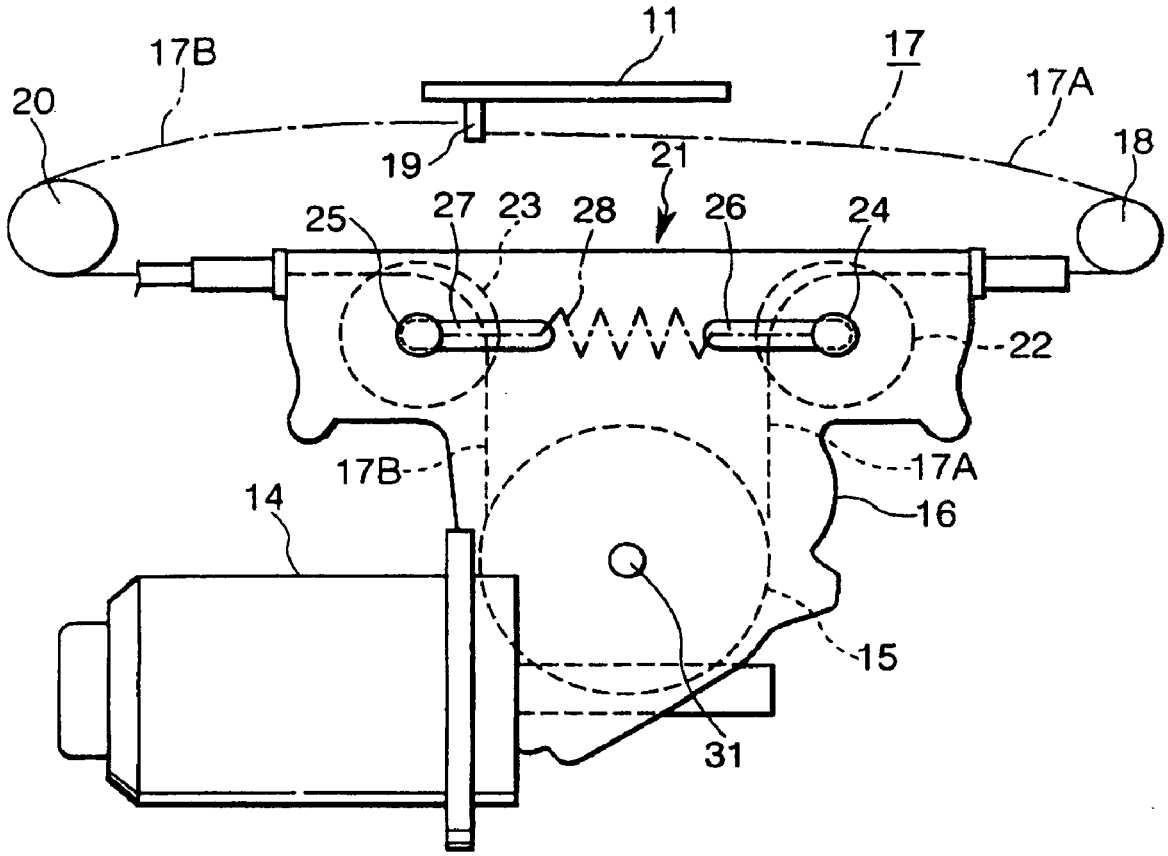
FIG. 4 is a development of the power slide device and the slide door.
Figure 5:
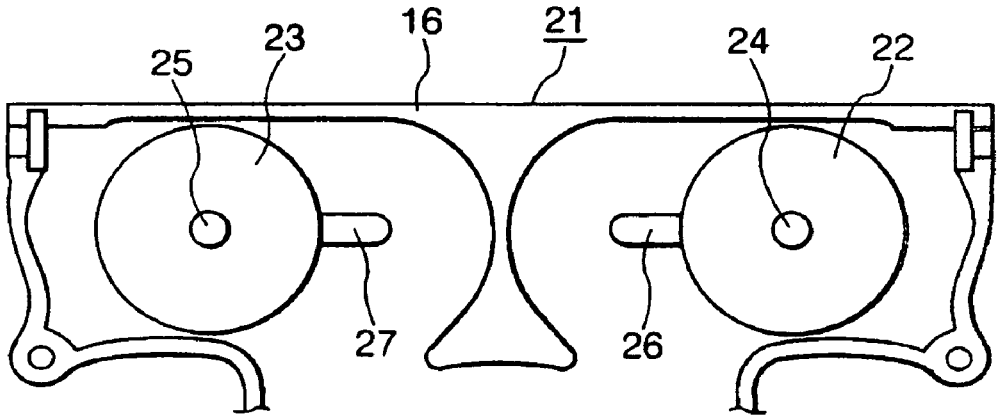
FIG. 5 is a partially abbreviated sectional view of a tension mechanism of the power slide device.

A first embodiment of the present invention will be described below with reference to the drawings. FIG. 3 shows a rough relation between a power slide device 10 of the present invention and a slide door 11 for vehicle which slides in a door-closing direction and a door-opening direction by the power slide device 10. FIG. 4 shows a developed relation between both the device 10 and the door 11.

The slide door 11 is slidably attached to a vehicle body 12, and slides in the backward and forward direction of the vehicle body 12 along a guide rail 13 provided on the vehicle body 12. The slide device 10 has a motor 14 and a wire drum 15 rotated by the motor 14, and these elements are attached to a base plate 16 fixed to the vehicle body 12.

The wire-drum 15 is connected with a pair of wire cables 17, that is, tip end sides of the door-opening cable 17A and the door-closing cable 17B, respectively. When the wire drum 15 rotates in the door-opening direction, the door-opening cable 17A is wound up, and the door-closing cable 17B is pulled out, and the slide door 11 is slid in the door-opening direction. When the wire drum 15 is rotated in the door-closing direction, the door-opening cable 17A is pulled out, and the door-closing cable 17B is wound up, and the slide door 11 is slid in the door-closing direction.

The other end of the door-opening cable 17A is connected to a bracket 19 of the slide door 11 through a rear side pulley 18 pivotally mounted on the vehicle body 12. Similarly, the other side of the door-closing cable 17B is connected to the bracket 19 through a front side pulley 20 pivotally mounted on the vehicle 12.

The base plate 16 is provided with a tension mechanism 21 retaining a tension of the wire cable 17 at an appropriate pressure. The tension mechanism 21 has a pair of tension rollers 22 and 23 abutted against by the cables 17A and 17B. The tension shafts 24 and 25 of the tension rollers 22 and 23 are slidably attached to elongated slots 26 and 27 formed on the base plate 16. The tension rollers 22 and 23 are biased in such a manner as to be mutually approached by elastic force of the tension spring 28. Reference numeral 29 denotes a cover case of the tension mechanism 21.

Both upper and lower ends of the tension roller 22, as shown in FIG. 6, are formed with flanges 22A and 22A, and a cable abutting surface 22B between the flanges 22A and 22A is formed on an inclined surface which becomes gradually shorter in diameter from the bottom to the top. Similarly, both upper and lower ends of the tension roller 23 are formed with flanges 23A and 23A, and the cable abutting surface 23B between the flanges 23A and 23A is formed on an inclined surface which becomes gradually longer in diameter from the bottom to the top. In the present embodiment, the cable abutting surface 22B and the cable abutting surface 23B are inclined mutually in a reverse direction, and when the upper portion of one abutting surface becomes long in diameter, the upper portion of the other abutting surface becomes short in diameter. This depends on an attachment relation among the wire drum 15, the door-opening cable 17A, and the door-closing cable 17B to be described later.

FIG. 7 shows a relation between the wire drum 15 and the tension rollers 22 and 23 in the present invention. The door-opening cable 17A and the door-closing cable 17B are wound around the engaging groove 30 of the wire drum 15. When the slide door 11 is in a door-closed position, the door-opening cable 17A is pulled out from the engaging groove 30 of the wire drum 15, and the door-closing cable 17B is wound up by the engaging groove 30 of the wire drum 15. At this time, in the embodiment of FIG. 7, the relation is established such that both the door-opening cable 17A and the door-closing cable 17B are positioned at the bottom side of the wire drum 15. When the wire drum 15 is rotated in a door-opening direction about the drum shaft 31 as a center, the door-opening cable 17A, while being wounded, is guided to the engaging groove 30, and moves upward as shown by an arrow b, and the door-closing cable 17B already wounded around the engaging groove 30, while being pulled out, similarly moves upward as shown by an arrow c (the relation is reversed at the door-closing rotation of the wire drum). Further, both the door-opening cable 17A and the door-closing cable 17B move from the long diameter side to the short diameter side of the tension rolls 22 and 23 when wound up by the drum 15. Hence, in the present embodiment, the cable abutting surface 22B and the cable abutting surface 23B incline in a mutually reversed direction.

However, the relation between the wire drum 15 and the cables 17A and 17B becomes sometimes such that, when the wire drum 15 rotates, depending on the shape of the engaging groove 30 of the wire drum 15, one of the cables moves upward and the other moves downward. In this case, inclinations of the cable abutting surface 22B and the cable abutting surface 23B are set in the same direction, and the cable to be wound up is changed so as to move toward the short diameter of the abutting surface.

(Operation)

When the slide door 11 is at the door-closed position, the door-opening cable 17A has been pulled out from the engaging grove 30 of the wire drum 15, and the door-closing cable 17B has been wound up by the engaging groove 30 of the wire drum 15. In this state, when the wire drum 15 is rotated in the door-opening direction, in the embodiment of FIG. 7, the door-opening cable 17A, while being wound up, is guided to the engaging groove 30, and moves upward, and further, the door-closing cable 17B already wound up by the engaging groove 30, while being pulled out, similarly moves upward.

At this time, since the door-opening cable 17A moves toward the upper side (short diameter side) of the cable abutting surface 22B when wound up, and the angle X between the lower side surface of the cable abutting surface 22B of the tension roller 22 and the cable 17A is below 90 degrees due to the inclination of the abutting surface 22B, when the door-opening cable 17A moves upward relatively to the tension roller 22, the delay of the upward movement for the tension roller 22 is controlled, and the door-opening cable 17A to be wound up is smoothly wound up.

FIG. 8 shows a measurement result of the "cable rubbing noise" according to the angle of the cable abutting surface 22B of the tension roller 22. At the cable pulling out side, no matter whatever angle the cable abutting surface has, no generation of sounds that becomes a problem has been recognized. However, at the cable winding side, when the angle of the cable abutting surface is zero degree (when the cable abutting surface 22B is in parallel with the drum shaft 31), the generation of sounds has been recognized. When the inclination is made three degrees, the noise has been considerably controlled. In case the angle is five degrees, no generation of noises has been substantially recognized. The suitable angles of the cable abutting surfaces 22B and 23B, in spite of the slight fluctuation depending on the factor such as the distance and the like between the tension rollers 22 and 23 and the wire drum 15, are desirable to be three to seven degrees.

What is claimed is:

1. A power slide device for sliding door, comprising:

a wire drum rotated by a motor;

a first cable connected to the wire drum and moving in a first direction when wound up by the wire drum;

a second cable connected to the wire drum and moving in a second direction when wound up by the wire drum;

wherein, when the wire drum rotates in a door-opening direction, the first wire cable is wound up by the wire drum, and at the same time, the second wire cable is pulled out from the wire drum so as to allow the slide door to be slid in the door-opening direction, and when the wire drum rotates in a door-closing direction, the first cable is pulled out from the wire drum, and at the same time, the second cable is wound up by the wire drum so as to allow the slide door to be slid in the door-closing direction;

a first tension roller having a first abutting surface abutting against the first cable; and a second tension roller having a second abutting surface abutting against the second cable;

wherein the first abutting surface has an inclined surface becoming gradually shorter in diameter toward the first direction along the entire height thereof, and the second abutting surface is made an inclined surface becoming gradually shorter in diameter toward the second direction along the entire heights thereof.

2. The power slide device for sliding door according to claim 1, wherein the inclined angles of the first abutting surface and the second abutting surface are made three to seven degrees.

* * * * *